US008028859B2

(12) United States Patent
Paetow et al.

(10) Patent No.: US 8,028,859 B2
(45) Date of Patent: Oct. 4, 2011

(54) FOIL CONTAINER WITH FOIL BAG CHAMBERS WHICH ARE ARRANGED NEXT TO ONE ANOTHER

(75) Inventors: Mario Paetow, Igling (DE); Markus Koegler, Kaufering (DE); Christian Hefele, Breitenbrunn (DE); Andreas Schell, Issing (DE)

(73) Assignee: Hilti Aktiengesellschaft, Schaan (LI)

( * ) Notice: Subject to any disclaimer, the term of this patent is extended or adjusted under 35 U.S.C. 154(b) by 449 days.

(21) Appl. No.: 12/286,347

(22) Filed: Sep. 29, 2008

(65) Prior Publication Data

US 2009/0084815 A1 Apr. 2, 2009

(30) Foreign Application Priority Data

Oct. 1, 2007 (DE) ..... 10 2007 000 802

(51) Int. Cl.
*B65D 35/22* (2006.01)

(52) U.S. Cl. ..... 222/94; 222/107; 222/145.5; 222/145.6

(58) Field of Classification Search ..... 222/92–95, 222/105, 107, 145.1, 325, 145.5, 135, 145.6, 222/137, 326–327
See application file for complete search history.

(56) References Cited

U.S. PATENT DOCUMENTS 4,340,154 A * 7/1982 VanManen ..... 222/94
4,366,919 A * 1/1983 Anderson ..... 222/137
4,585,149 A * 4/1986 Zulauf ..... 222/94
5,310,091 A * 5/1994 Dunning et al. ..... 222/135
5,360,144 A * 11/1994 Slade ..... 222/134
5,647,510 A * 7/1997 Keller ..... 222/94
5,873,492 A * 2/1999 Sullivan ..... 222/105
6,129,243 A * 10/2000 Pal et al. ..... 222/94
6,161,730 A 12/2000 Heusser
6,620,125 B1 9/2003 Redl
6,634,524 B1 * 10/2003 Helmenstein ..... 222/94
6,880,725 B2 * 4/2005 De Laforcade ..... 222/94
7,306,126 B2 * 12/2007 Brugner ..... 222/485
7,306,130 B2 * 12/2007 Brugner ..... 222/541.6
7,510,546 B2 * 3/2009 Baessler et al. ..... 604/408

FOREIGN PATENT DOCUMENTS

BE 008 472 A3 5/1996

* cited by examiner

*Primary Examiner* — Frederick C. Nicolas

(74) *Attorney, Agent, or Firm* — Abelman, Frayne & Schwab

(57) ABSTRACT

A foil container (11) has two foil bag chambers (12, 16) arranged next to one another for compound components of a multi-component compound which are stored separately from one another, and a head (21) having a base plate (22) with a contact side (23) at which two receptacle portions (24, 25) are provided, each for one end of the respective foil bag chambers (12, 16), and a mixer connection (31) in which there are provided a first outlet opening (33) for one of the compound components of the multi-component compound and a second outlet opening (34) for an additional compound component of the multi-component compound and arranged in the first outlet opening (33).

3 Claims, 1 Drawing Sheet

FOIL CONTAINER WITH FOIL BAG CHAMBERS WHICH ARE ARRANGED NEXT TO ONE ANOTHER

BACKGROUND OF THE INVENTION

1. Field of the Invention

The invention relates to a foil container for storing a compound and insertable in a receptacle of a ejection device and having foil bag chambers arranged next to one another for compound components of a multi-component compound which are stored separately from one another, and a head which has a base plate with a contact side at which at least one receptacle portion is provided for an end of the foil bag chambers, and a mixer connection at the base plate, with a first outlet opening for one of the compound components of the multi-component compound and at least one additional outlet opening for at least one additional compound component of the multi-component compound provided in the mixer connection.

2. Description of the Prior Art

Multi-component compounds such as, for example, mortar compounds, foam compounds, and sealing compounds are made available to the user as two-compound component or multi-component compounds in cartridges and foil containers. Foil containers have proven successful as packaging for compounds of this type and are distinguished in particular by the small proportion of material to be disposed of after the compound is dispensed compared to cartridges. Further, foil containers are simple and inexpensive to produce.

The foil container is inserted or guided into a receptacle of an ejection device such as, e.g., a dispenser. The compound components are ejected out simultaneously through outlet openings at the head by an ejection mechanism so as to be guided through a mixer housing with a mixing element in which the individual compound components are mixed to form the desired compound and are dispensed at the application location.

DE 91 00 054 U1 discloses a foil container with two foil bags arranged side by side as foil bag chambers. The mixer connection has a dividing wall for creating two outlet openings located next to one another, each of them feeding one compound component of the two-component compound to a mixing element. This feed in the mixer connection is also known as a side-by-side feed.

The known solution is disadvantageous in that, owing to the dividing wall in the mixer connection, the compound components flow parallel next to one another along the inner wall of the mixer connection when the foil container is squeezed. Accordingly, a high mixing energy or a long mixing path with a correspondingly designed mixing element is required for a sufficiently thorough mixing of the compound components. Consequently, high ejection forces are required for dispensing the multi-component compound.

SUMMARY OF THE INVENTION

It is the object of the invention to provide a foil container with foil bag chambers which are arranged next to one another, and with a head in which a uniform mixing result is ensured over the entire ejection process with different types of mixing elements and with reduced ejection forces.

This and other objects of the present invention are achieved by providing a foil container in which the at least one additional outlet opening is arranged in the first outlet opening.

The at least one additional outlet opening is arranged in the clear cross-section of the first outlet opening. The first outlet opening has a wall facing inward which defines the clear cross-section of the first outlet opening. The at least one additional outlet opening is arranged at a distance from the wall of the first outlet opening and is accordingly surrounded, advantageously completely, by the first outlet opening. Since one of the compound components is fed to the mixing element in the mixer housing within the at least one other compound component, all of the mixing steps of the mixing element which are adjacent to the outlet openings are completely wrapped around each other. This ensures a maximum possible blending of the compound components, so that the compound, which exits from the mixer housing, is mixed to the required degree over the entire process of squeezing the foil container.

When the mixing element is not radially symmetrical, a compound component can no longer flow past one of the wall portions of the mixing element at the start of the mixing process, depending on the position of the mixing element in the mixer housing, as was possible with a side-by-side feed. Irregular mixing results or variations in the extent of mixing of the compound components over the course of the ejection process are eliminated by the feeding process according to the invention. Since it is ensured that the compound components are thoroughly mixed with one another to a degree that can be reliably predetermined, fewer mixing steps are required for a correct blending of the compound components, and the mixing element can therefore be constructed so as to be shorter. Because of the shorter mixing path, smaller forces are sufficient for squeezing out the foil container, which makes it possible to use simple and inexpensive ejection devices.

With the foil container according to the invention, compound components with different viscosities can be dispensed, while ensuring a sufficiently thorough mixing, and low-viscosity compounds need not be thickened. By eliminating the thickening, smaller forces are required for squeezing out such compounds.

In an advantageous manner, the smaller of the compound components with respect to the ratio of compound components is guided through the at least one additional outlet opening. In case of a multi-component compound with a hardener as additional compound component, the latter is advantageously guided through the at least one additional outlet opening. With a side-by-side feed, there is adhesion to the inner wall of the outlet opening particularly in case of a hardener, so that the hardener is not only guided laterally, possibly past mixing steps into the mixing element, but also a constant supply of the required amount of hardener, as additional compound component, is not always guaranteed over the entire ejection process. However, with the advantageous feed mentioned above, all of the mixing steps are completely wrapped around each other with all of the compound components during the entire ejection process.

The head is advantageously made of plastic in an injection-molding process. Due to the fact that the at least one additional outlet opening is arranged in the first outlet opening, the manufacture-dependent geometric warping that occurs in a side-by-side feed with a separating web, is eliminated when ejecting from the mold. Apart from a simpler ejection from the mold, the sealing of the mixer connection with the head is also improved by the simpler geometry of the head.

Preferably, the at least one additional outlet opening is arranged coaxial to the first outlet opening, which ensures an advantageous feeding of the compound components to the mixing element. The mixer connection has a longitudinal extension extending in direction of the mixing element and mixer housing. The at least one additional outlet opening is arranged on the longitudinal extension of the mixer connection coaxially with the first outlet opening. In particular, when the mixing elements are not radially symmetrical, they need no longer be oriented exactly with respect to the mixer connection, as was previously required, in order to ensure a sufficiently thorough mixing of the compound components over the existing mixing steps of the mixing element.

The clear cross-section of the at least one additional outlet opening is preferably round. For example, the clear cross-section of the at least one additional outlet opening is circular or oval. The head is easy to manufacture and ensures an advantageous combining of the compound components in the mixing element.

In another advantageous embodiment, the at least one second outlet opening has a polygonal clear cross-section. This head is likewise simple to manufacture and ensures an advantageous combining of the compound components in the mixing element. The at least one additional outlet opening advantageously has a trapezoidal clear cross-section.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

Identical parts are provided with the same reference numerals in the drawings.

DETAILED DESCRIPTION OF THE PREFERRED EMBODIMENTS

Figure 1:
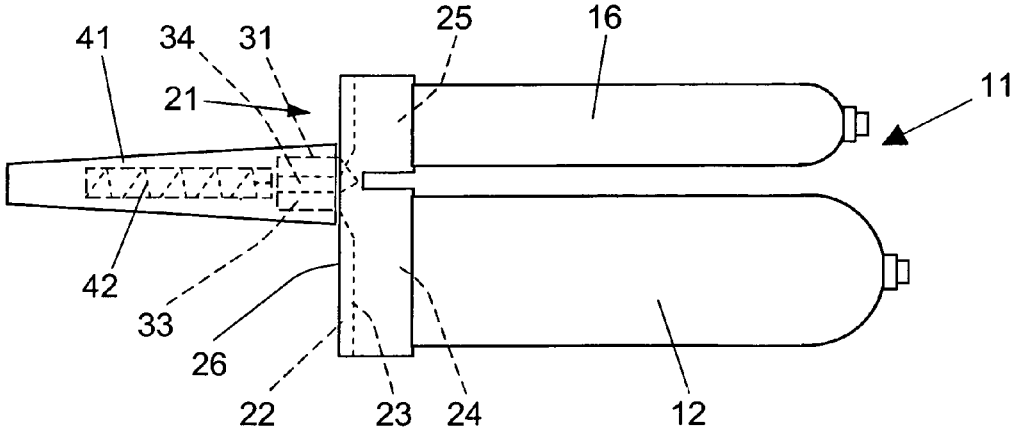
FIG. 1 a side view of a foil container according to the present invention.
Figure 2:
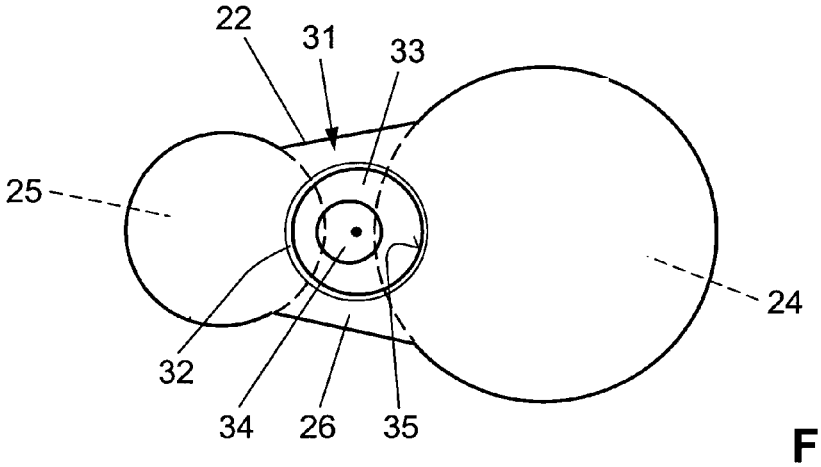
FIG. 2 a left side view of a first embodiment of a head of the foil container shown in FIG. 1.

The foil container 11 according to the present invention and designed for storing a compound and for insertion into a receptacle of a ejection device, not shown, and which is shown in FIGS. 1 and 2, has two foil bag chambers 12 and 16 for compound components of a multi-component compound, which are stored separately from one another, and which foil bag chambers 12 and 16 are arranged next to one another. Further, the foil container 11 has a head 21 with a base plate 22 having, at a contact side 23, a receptacle portion 24 for one end of the foil bag chamber 12 and a receptacle portion 25 for one end of the foil bag chamber 16. A mixer connection 31 with an external thread 32 for the connection of a mixer housing 41 with a mixing element 42 is provided at a side 26 of the base plate 22 located opposite the contact side 23. In the mixer connection 31, there are provided a first outlet opening 33 with a circular clear cross-section defined by a wall 35 facing inward. The compound components of the multi-component compound located in the foil bag chamber 12 are dispensed from the first outlet opening 33 during the ejection process, and a second outlet opening 34 formed as a circular clear cross-section. The compound components of the multi-component compound located in the foil bag chamber 16 are dispensed from the outlet opening 34 during the ejection process. The second outlet opening 34 is arranged in the first outlet opening 33 at a distance from the wall 35 of the first outlet opening 33 and so as to be slightly offset with respect to the latter. The first outlet opening 33 has an annular clear cross-section which completely surrounds the second outlet opening 34.

Figure 3:
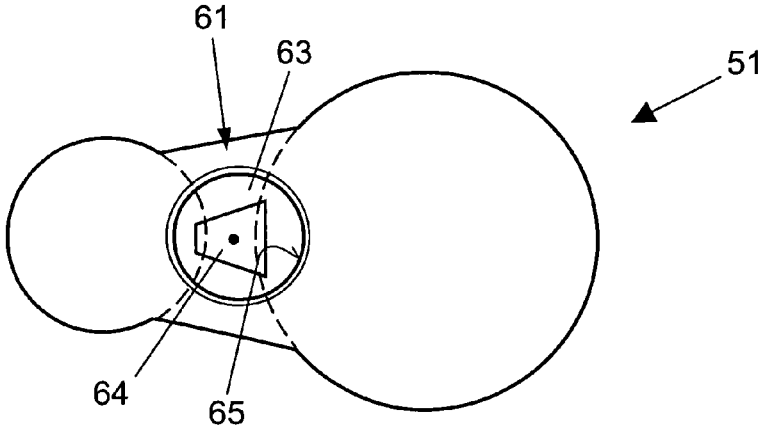
FIG. 3 a view similar to that of FIG. 2 of a second embodiment of a head of the foil container shown in FIG. 1.

FIG. 3 shows as a further embodiment of the head 51 whose features correspond to the head 21 described above with the exception of the construction of the mixer connection 61. A first outlet opening 63 with a round clear cross-section defined by an inwardly directed wall 65, and a second outlet opening 64 with a trapezoidal or polygonal clear cross-section are provided in the mixer connection 61. The outlet opening 64 is arranged in the clear cross-section of the first outlet opening 63 at a distance to its wall 65. The surface centroid of the trapezoidal clear cross-section of the second outlet opening 64 is arranged coaxially with the center of the clear cross-section of the first outlet opening 63 which is circular in this instance.

Though the present invention was shown and described with references to the preferred embodiments, such are merely illustrative of the present invention and is not to be construed as a limitation thereof, and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A foil container for storing a multi-component compound and insertable in a receptacle of an ejection device, comprising at least two foil bag chambers (12, 16) for compound components of the multi-component compound which are stored separately from one another, the foil bag chambers (12, 16) being arranged side-by-side; and a head (21; 51) having a base plate (22) with a contact side (23) at which at least one receptacle portion (24, 25) is provided for an end of the foil bag chambers (12, 16) and a mixer connection (31; 61) at the base plate (22), and in which there are provided a first outlet opening (33; 63) for one of the compound components of the multi-component compound, and at least one additional outlet opening (34; 64) for at least one additional compound component of the multi-component compound, the at least one additional outlet opening (34; 64) being arranged in the first outlet opening (33; 63) coaxially with the first outlet opening (33; 63).

2. A foil container according to claim 1, wherein the at least one additional outlet opening (34) has a circular cross-section.

3. A foil container according to claim 1, wherein the at least one additional outlet opening (64) has a polygonal cross-section.

* * * * *